US005096241A

United States Patent [19]

Badger

[11] Patent Number: 5,096,241

[45] Date of Patent: Mar. 17, 1992

[54] LATCH MECHANISM INTERRUPTER AND METHOD OF USE

[76] Inventor: Kenneth J. Badger, 750 S. Coors Ct., Lakewood, Colo. 80228

[21] Appl. No.: 679,269

[22] Filed: Apr. 2, 1991

[51] Int. Cl.[5] ..... E05D 13/04

[52] U.S. Cl. ..... 292/288; 16/86 A; 292/300

[58] Field of Search ..... 292/150, 153, 258, 288, 292/289, 341.14, 343, 300; 16/86 A; 29/526

[56] References Cited

U.S. PATENT DOCUMENTS 2,726,892 12/1955 Zynda et al. ..... 292/341.14
2,727,650 12/1955 Moynihan et al. ..... 292/288 X
3,312,490 4/1967 MacDonald ..... 292/153
3,352,587 11/1967 Harvey ..... 292/289
4,208,841 6/1980 Starks ..... 292/343 X
5,004,279 4/1991 Radcliff ..... 292/288

FOREIGN PATENT DOCUMENTS 422489 1/1935 United Kingdom ..... 292/341.14

*Primary Examiner*—Richard E. Moore
*Attorney, Agent, or Firm*—McClung, Guy

[57] ABSTRACT

Methods and apparatuses for preventing latching of a door panel, or other closure device, the apparatus including a body member for blocking action of a latch mechanism and an adhering member for releasably attaching the body member to a part of the latch mechanism.

5 Claims, 1 Drawing Sheet

FIG. 1A
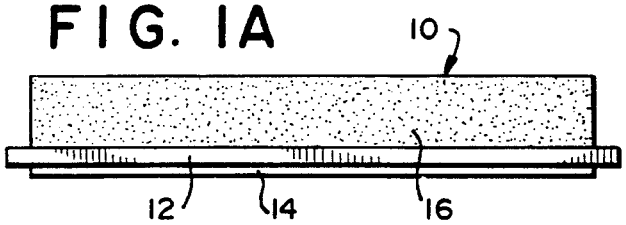
FIG. 1B
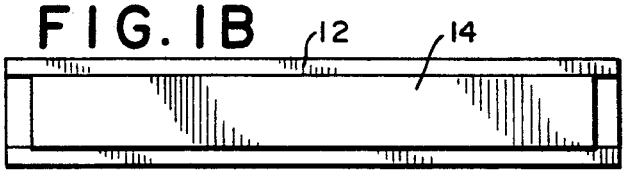
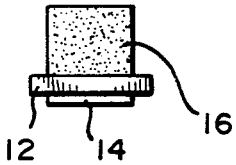
FIG. 1C
FIG. 3
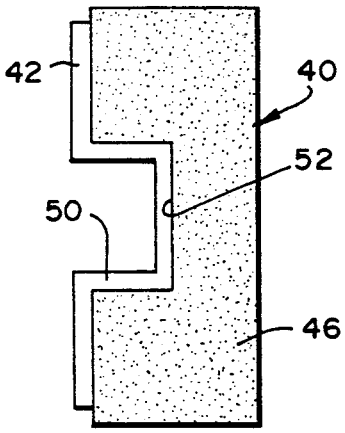
FIG. 4
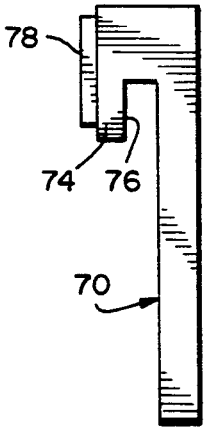
FIG. 5
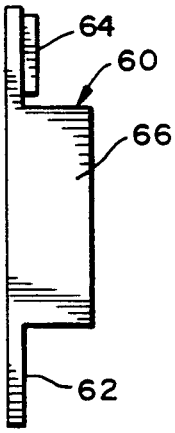
FIG. 6
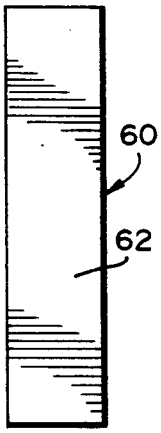
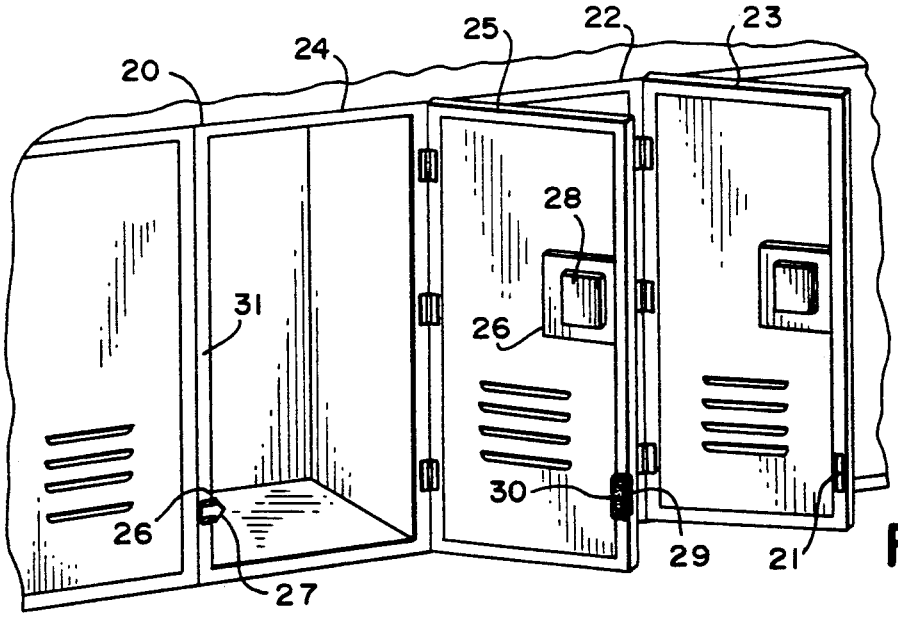
FIG. 2

LATCH MECHANISM INTERRUPTER AND METHOD OF USE

BACKGROUND OF THE INVENTION

1. Field Of The Invention

This invention is directed to a device for defeating the action of a latch and, in one aspect, to such a device for interrupting the latching action of a latch for a door of a storage locker.

2. Description Of Related Art

With a variety of prior art latches and doors with such latches, an inadvertent closing of the door requires another unlatching of the door. If the door has a locking mechanism in addition to the latching mechanism, inadvertent closing of the door may also require unlocking of the door. If the lock is of the combination type, this can be bothersome and time consuming, especially if the locker is a student's locker and the student only has a short time in which to access the locker and rush off to another class. It is particularly bothersome when a fellow student closes a locker door on purpose knowing that the user will need to again go through the required procedure to unlock a combination lock.

Additional mechanisms within an existing latch or lock mechanism for selectively deactivating the latch or lock mechanism would be relatively complex and would require the user to engage and disengage them properly.

There has long been a need for an efficient latch mechanism interrupter. There has long been a need for such an interrupter that is simple and is easily manipulated. There has long been a need for such an interrupter which is easily transported and stored.

SUMMARY OF THE PRESENT INVENTION

The present invention, in one embodiment, discloses a latch mechanism interrupter with a main body member which is sized and configured to block an opening of a latch mechanism so that a latching member cannot be received in the opening, thereby preventing the latch from working. The body member has an adhesive or magnetic member for removably securing it over the opening. It is preferred that a shock absorbing material, preferably soft foam, be applied to the body member so that the latching member strikes something that will not deform the latching member in the event a door with the opening is inadvertently slammed shut. The mechanism can be easily removed from the opening and placed on the door, on a part of a locker or container that includes the door, or in a person's pocket or purse. In another embodiment, the latch mechanism interrupter is configured to fit on or over the latching member rather than a latch opening. In other embodiments, the interrupter hangs on the latch member or in the latch opening or has a portion insertable into the latch opening.

It is, therefore, an object of the present invention to provide new, useful, unique, nonobvious, efficient, and effective devices for interrupting the latching action of a latching mechanism when latching is not desired.

Another object of the present invention is the provision of such devices which are easily manipulated, installed, and removed.

Yet another object of the present invention is the provision of such devices whose use does not result in injury to or deformation of parts of a latching mechanism.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

FIG. 1A is a side view of a latch mechanism interrupter according to the present invention.

FIG. 1B is a bottom view of the interrupter of FIG. 1A.

FIG. 1C is an end view of the interrupter of FIG. 1A.

FIG. 2 is a front view of a row of lockers with latch mechanisms showing an interrupter as in FIG. 1 installed on one locker's door.

FIG. 3 is a side view of a latch interrupter according to the present invention.

FIG. 4 is a side view of a latch interrupter according to the present invention.

FIG. 5 is a side view of a latch interrupter according to the present invention.

FIG. 6 is a front view of the interrupter of FIG. 4.

DESCRIPTION OF EMBODIMENTS PREFERRED AT THE TIME OF FILING FOR THIS PATENT

Referring now to FIGS. 1A, 1B, and 1C, an embodiment of an interrupter 10 according to the present invention has a body member 12 to which is secured a magnetic member 14 on one side and a shock absorbing member 16 on the other side. The magnetic member 14 can be any size and configuration sufficient to magnetically attach the interrupter 10 to a door or other item having an opening for receiving a latch member of a latch mechanism. The shock absorbing member 16 is disposed so that a latch member will contact the shock absorbing member upon movement of the door toward the latch member to cushion the impact of the latch member with the interrupter.

Although the member 14 is shown as magnetic, it is within the scope of this invention for it to be any suitable adhesive apparatus which will permit the interrupter 10 to be removably emplaced about a door opening (e.g. tape, Velcro (TM) material, etc.)

Referring now to FIG. 2, a row of lockers 20 has a locker 22 with a door 23 having a latch member opening 21 therein. A locker 24 has a door 25 and a latch mechanism 26 that includes a latch member 27 on a door frame 31 and a door opening 29. Behind the door opening 29 is a latch member holder (not shown) which moves adjacent the opening 29 within the door for releasably holding the latch member 27 depending on the status of a combination lock mechanism 28. The latch member holder coacts with the lock.

An interrupter 30 according to the present invention (like interrupter 10, FIG. 1A) is in place over the opening 29 to prevent entry of the latch member 27 into the door opening 29, thereby preventing inadvertent closing and locking of the door 25.

Referring now to FIG. 3, a latch interrupter 40 according to the present invention has a magnetic body member 42 to which is secured a shock absorbing rubber member 46. The body member 42 has a recess 50 formed therein and the shock absorbing member 46 has a corresponding recess 52 formed therein. The recess 50 is configured to enclose, and therefore, block off a latch member (e.g. latch member 27, FIG. 2) when the interrupter 40 is emplaced over the latch member. Since the body member 42 is magnetic, the interrupter 40 is held in place about the latch member by magnetic contact of the body member 42 with a metal frame or other metal part adjacent the latch member. Alternatively, if a non-magnetic body member is used, an adhesive material, adhesive strips, or cooperatively releasing fastener material [e.g. VELCRO (TM) material] may be used to releasably attach the interrupter 40 about a latch member.

Referring now to FIGS. 5 and 6, a latch interrupter 60 according to the present invention has a body member 62 with a magnetic member 64 secured to it for attaching the interrupter 60 at a latch opening like the latch opening 21 of the embodiment shown in FIG. 2). A protruding portion 66 of the body member 62 is configured and shaped to be receivable in a latch opening (like the latch opening 21 of the embodiment shown in FIG. 2). If the protruding portion 66 is configured for a snug fit in the opening, no magnetic member (or other additional attachment means) is needed to hold the latch interrupter in place.

FIG. 4 illustrate another form of a latch interrupter 70 according to the present invention. A body member 72 has a hook portion 74 formed about a recess 76. The body member 72 can be hooked onto a latch member (like the latch member 22 of the embodiment shown in FIG. 2) or in a latch opening (like the latch member 22 of the embodiment shown in FIG. 2) to prevent the latching engagement of a latch mechanism. A magnet 78 may be secured to the body member 72 to facilitate attachment of the latch interrupter 70 or to hold it in position. The interrupters 40 and 70 when viewed from the front look like the view of the interrupter 60 shown in FIG. 6.

The latch interrupters shown in FIGS. 1A, 1B, 1C, 4 and 5 are emplaced over a door latch opening or partially within a door latch opening so that a latch member normally received in the opening is prevented from entering the opening. The latch interrupter 50 shown in FIG. 3 is disposed about a latch member (rather than over or in a latch opening) to block entry of the latch member into a latch opening.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. Latch mechanism interrupter for preventing operation of a latch mechanism of a door mounted to a frame, the latch mechanism including a latch member on the frame receivable in a door opening of the door and holdable there to latch the door shut, the interrupter comprising a body member, and the body member having magnetic attachment means for removably magnetically attaching the interrupter to a metal member adjacent the door opening to prevent entry of the latch member into the door opening.

2. Latch mechanism interrupter for preventing operation of a latch mechanism of a door mounted to a frame, the latch mechanism including a latch member on the frame receivable in a door opening of the door and holdable there to latch the door shut, the interrupter comprising a body member, the body member having attachment means for removably attaching the interrupter at the door opening to prevent entry of the latch member into the door opening, the attachment means comprising a portion of the body member snugly receivable in the door opening to removably hold the interrupter in place, and a magnetic member secured to the body member for attaching the interrupter to a metal member adjacent the door opening.

3. Latch mechanism interrupter for preventing operation of a latch mechanism of a door mounted to a frame, the latch mechanism including a latch member on the frame receivable in a door opening of the door and holdable there to latch the door shut, the interrupter comprising a body member, and the body member having magnetic attachment means for removably magnetically attaching the interrupter to a metal member adjacent the latch member to prevent entry of the latch member into the door opening.

4. Latch mechanism interrupter for preventing operation of a latch mechanism of a door mounted to a frame, the latch mechanism of a door mounted to a frame, the latch mechanism including a latch member on the frame receivable in a door opening of the door and holdable there to latch the door shut, the interrupter comprising a body member, the body member having attachment means for removably attaching the interrupter to the latch member to prevent entry of the latch member into the door opening, and the attachment means comprising a hook portion of the body member removably attachable to the latch member.

5. The interrupter of claim 4 including also a magnetic member secured to the body member for attaching the interrupter to a metal member adjacent the latch member.

* * * * *